US005415590A

United States Patent [19]

Steingraber et al.

[11] Patent Number: 5,415,590

[45] Date of Patent: May 16, 1995

[54] PLAYGROUND SPRING DEVICE

[75] Inventors: Larry L. Steingraber, Slinger, Wis.; Ahmet Kartal, Villa Rica, Ga.

[73] Assignee: BCI Burke Company, Inc., Fond du Lac, Wis.

[21] Appl. No.: 127,657

[22] Filed: Sep. 27, 1993

[51] Int. Cl.[6] ..... A63K 1/00

[52] U.S. Cl. ..... 473/103; 248/632

[58] Field of Search ..... 472/4, 5, 95, 102, 103, 472/106, 110, 111, 113, 135; 248/632, 609, 615, 634, 636, 900, 548

[56] References Cited

U.S. PATENT DOCUMENTS

| | | | |
|---|---|---|---|
| 2,699,934 | 1/1955 | Boschi | 248/615 X |
| 2,964,094 | 12/1960 | Gariepy | 248/632 |
| 4,067,525 | 1/1978 | Allen | 248/632 |

FOREIGN PATENT DOCUMENTS

| | | | |
|---|---|---|---|
| 651358 | 3/1951 | United Kingdom | 248/632 |

*Primary Examiner*—Carl D. Friedman
*Assistant Examiner*—Creighton Smith
*Attorney, Agent, or Firm*—Quarles & Brady

[57] ABSTRACT

An elastomeric spring device for use with playground equipment which substantially reduces the risk of any pinching to the user. The spring device has a hollow dome configuration with mounting members at each end. The dome has a smaller diameter upper portion with one of the mounting members being coextensive therewith. The spring device is particularly suited for use with rock and ride and see-saw playground equipment.

17 Claims, 2 Drawing Sheets

FIG. 1
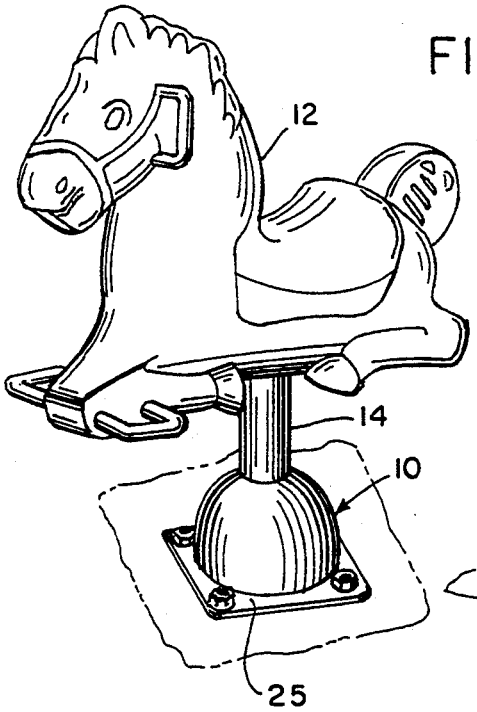
FIG. 2
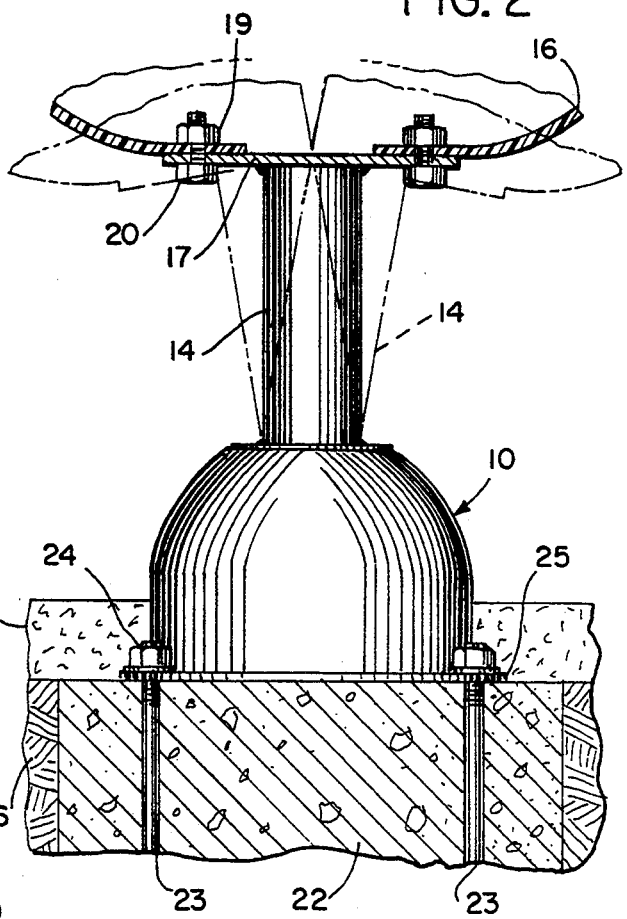
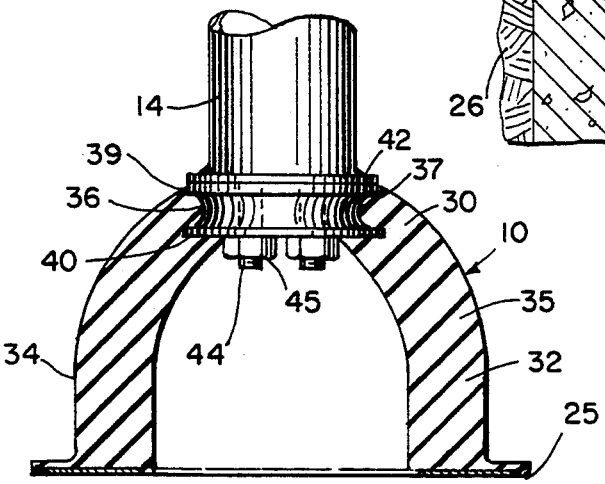
FIG. 3

FIG. 4
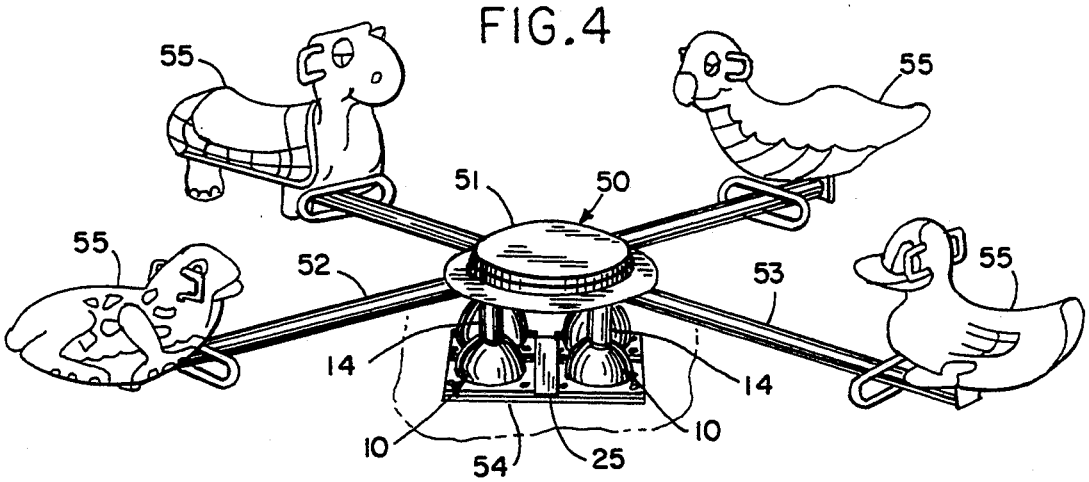
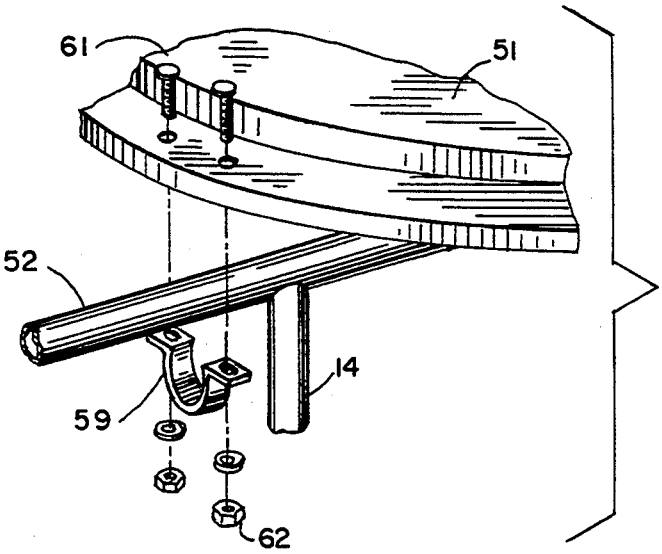
FIG. 5
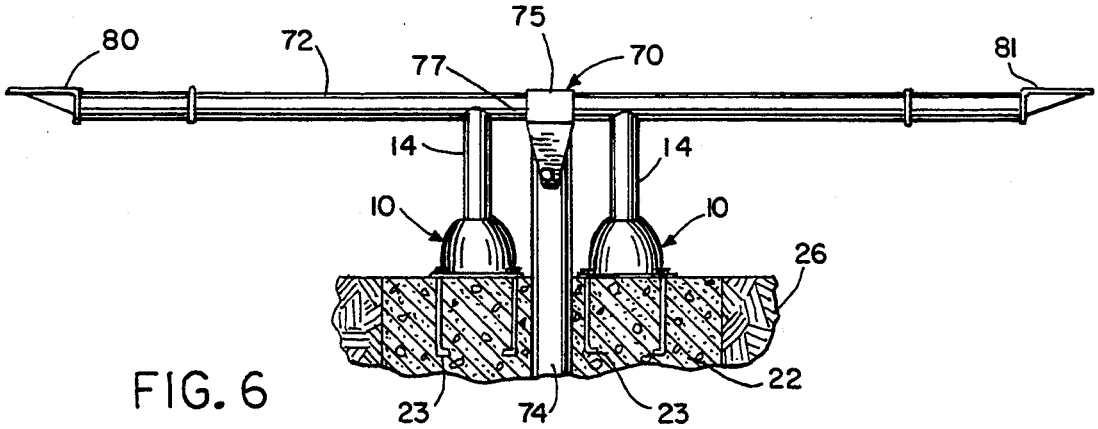
FIG. 6

PLAYGROUND SPRING DEVICE

BACKGROUND OF THE INVENTION

This invention relates to a spring device for use in playground equipment. More particularly, it relates to a hollow dome spring device composed of an elastomeric material for use with such equipment which involves a rocking or teetering motion.

The use of elastomeric materials to effect a spring action in playground apparatus is well known. For example, U.S. Pat. Nos. 4,516,766; 3,837,610 and 3,675,919 all employ some type of elastomeric material in place of coil springs. Resilient biasing of certain playground equipment is also shown in U.S. Pat. Nos. 4,341,377; 3,836,140; and 3,204,953. While the elastomeric devices disclosed in these patents obviate some of the shortcomings of coil springs, they require specially designed enclosures, rocking mechanisms or closure plates which are susceptible to a pinching action. This is of concern where small children are involved.

U.S. Pat. No. 4,781,365 also discloses an elastomeric spring. However, it is designed for use in vehicle suspension systems.

It is an advantage of the present invention to provide a spring device for use with playground equipment which reduces the risk of injury to children.

It is another advantage of the present invention to provide a spring device of the foregoing type which is composed of an elastomeric material, is durable and has a long life span.

It is yet another advantage of the present invention to provide a spring device of the foregoing type which can be assembled or retrofitted to playground equipment using a minimum number of parts.

It is still another advantage of the present invention to provide a spring device of the foregoing type which can provide a multi directional rocking motion and therefore be employed with playground equipment of various types.

It is a still further advantage of the present invention to provide a process for producing a spring device of the foregoing type.

SUMMARY OF THE INVENTION

The foregoing advantages are accomplished by the present playground spring device which includes a substantially hollow dome member composed of an elastomeric material. The dome member is defined by a first diameter at one end which incrementally increases to a larger diameter with the larger diameter being maintained so as to provide a parallel side wall section. A first mounting member is connected to the dome member at the one end with the mounting member having a lateral dimension substantially no greater than the first diameter. A second mounting member is connected to the dome member at an end opposite the first end.

In a preferred manner, the elastomeric material is natural rubber.

In another preferred manner the larger diameter providing the parallel side wall section forms a larger portion of the dome member.

In still another preferred manner, the mounting members are partially embedded in the elastomeric material forming the dome member.

In yet another preferred manner, the spring device is connected to a rock and ride playground device or a see-saw.

In another aspect, a process for preparing the elastomeric spring is also presented.

BRIEF DESCRIPTION OF THE DRAWINGS

A better understanding of the present spring device will be accomplished by reference to the drawings wherein:

FIG. 1 is a front perspective view showing the spring device in conjunction with a playground riding unit.

FIG. 2 is an enlarged view of the spring device shown in and connected to the unit of FIG. 1 as well as anchored to the ground.

FIG. 3 is a view in vertical section of the spring device shown connected to a support post.

FIG. 4 is a perspective view showing four of the spring devices in use with a see-saw playground apparatus.

FIG. 5 is an enlarged partial view showing the connection of one of the arms of the see-saw in FIG. 4 to a cap member.

FIG. 6 is a view of an alternative embodiment of a see-saw with the spring devices connected thereto.

DESCRIPTION OF THE EMBODIMENTS

Referring to FIGS. 1–3, the spring device generally 10 is shown in conjunction with an animal seat unit 12. The seat unit 12 is connected to the spring device 10 by the support post 14 which at its upper end has a flange 17 for connection with the under frame 16 of the unit 12, the connection being made by the nuts 19 and the bolts 20. The spring device 10 is secured at the opposite end in a concrete base 22 by means of the anchored bolts 23 and nuts 24. The concrete base is placed in the usual ground 26 which is covered by the required resilient material 28.

Referring specifically to FIG. 3, it is seen that the spring device 10 is of a hollow dome shape with a small diameter portion 30 at the top which incrementally increases into a large diameter portion 32. The large diameter portion 32 forms a larger section of the hollow dome 35 and has a parallel side wall 34. It is seen that the hollow dome 35 is closed at one end by the mounting member 36 which is of a circular configuration and is partially embedded in the natural rubber material composing the dome 35. This is effected by the process for forming the spring device which is later described. The elastomeric material forming the dome 35 will fill into the concave circumferential wall 37 of the mounting member 36 and between the end walls 39 and 40. The mounting member 36 provides connection with the post 14 which has the flange 42 to which bolts 44 are secured therein and are attached to the mounting member 36 by the nuts 45. At the end of the dome 35 opposite mounting member 36, there is an additional mounting member 25 in the form of a flat metal plate which, like mounting member 36, is partially embedded with the rubber material forming dome 35.

Referring to FIGS. 4 and 5, there is shown a second embodiment of the spring device utilized in conjunction with a see-saw apparatus generally 50. Four of the spring devices 10 are utilized in this embodiment and have the support posts 14 connected thereto as previously described. The support posts 14 are in turn interconnected to the cross arms 52 and 53 which intersect at ninety degrees and in turn are secured to the cap member 51. This connection is afforded by the substantially U-shaped bracket 59 and the bolts 61 and nuts 62. At the ends of the arms 52 and 53 are the usual animal seat units 55. The see-saw apparatus 50 is secured in the ground in a manner similarly described in conjunction with FIG. 2 except that it has an intermediate support plate 54 on which the mounting member 25 is seated.

FIG. 7 shows still another embodiment of a see-saw apparatus generally 70. It utilizes two of the spring devices 10 and is anchored to the ground 26 in a manner similarly explained in conjunction with FIG. 2. The difference between embodiment 70 and embodiment 50 is that only a single cross arm 72 is employed, and in place of the cap 51, there is a central pivot bracket 75 pivotally attached to a pivot post 74 by the pivot pin 77. Pivot post 74 is anchored in the concrete base 22. There are the seat portions 80 and 81 at the ends of the arm 72. These also could accommodate the animal seat units 55.

The spring device 10 is produced by compression molding wherein the mold and cavity are preheated. The metal end pieces or mounting members 25 and 36 are placed in the mold at opposing positions. A preformed dome composed of natural rubber is placed in the mold. The mold parts are closed and the rubber dome is heated in the range of 280°–305° to effect vulcanization and partially embed the mounting members 25 and 36. Preferably an adhesive is placed on the metal parts 25 and 36 to bond the rubber to the metal. A commonly employed dual coated adhesive is used with one of the coats being a primer.

The natural rubber for forming the preformed dome was obtained from the Hoover Haynes Company in Talappoosa, Ga. While natural rubber is preferred because of its elasticity, neoprene rubber could be employed or it could be blended with natural rubber. In addition, other plastic compositions such as butadiene-styrene radial block copolymers having rubber characteristics and durometers as described herein could be employed alone or blended with natural or neoprene rubber.

The versatility of the dome shaped spring is seen from the fact that it can be formed from elastomeric materials having different durometers. For example, when it is employed as a spring for a rock and ride device, it will have a Shore A hardness of at least 75. When it is employed in the see-saw device, the hardness will be in the range of 45–85.

An important feature of the spring device is the hollow dome. It provides the required compression and opposing tension for a rocking or see-saw motion yet without undesired crash deflection. It was also found desirable to have the upper mounting member 36 of the same geometric or circular configuration as the dome, namely, that it also be rounded and not extend laterally from the dome. In tests performed using a square plate on the hollow dome, the desired rocking motion could not be obtained. The reason for this is surmised to be that the square configuration restricts multidirectional movement.

Comparison tests with a metal coil spring were also conducted. It was found that the metal coil spring failed between 18,000–22,400 cycles. The rubber spring performed for 500,000 cycles with a crack starting at 250,000 cycles. The crack was not large enough to result in a pinch point. Also in comparison to a metal coil spring when used in conjunction with the rock and ride unit 12 of FIG. 1, spring device 10 had a cycle every 3–4 seconds as compared to 1–1½ seconds for the spring device 10.

It will thus be seen that through the present invention there is now provided a novel spring device which is simple in its construction. It can afford a durable spring action unit having a cycle time which outlasts a comparable metal coil spring. Depending upon the durometer of the material forming the spring device, it can be used with various types of playground riding equipment. When so utilized, it provides a substantially pinch free apparatus.

The foregoing invention can now be practiced by those skilled in the art. Such skilled persons will know this invention is not necessarily restricted to the particular embodiments presented herein. The scope of the invention to be defined by terms of the following claims as given meaning by the preceding description.

We claim:

1. A playground spring device comprising:

a substantially hollow dome member composed of an elastomeric material, said dome member defined by a first diameter at one end, the first diameter incrementally increasing to a larger diameter, with the larger diameter being maintained so as to provide a parallel side wall section;

a first mounting member connected to said dome member at said one end, said mounting member having a largest lateral dimension substantially no greater than about said first diameter; and a second mounting member connected to said dome member at an end opposite the first end.

2. The spring device of claim 1 wherein the first mounting member has a circular configuration with a concave circumferential wall portion.

3. The spring device of claim 2 wherein the second mounting member is a substantially flat metal plate.

4. The spring device of claim 1 wherein the elastomeric material is natural rubber.

5. The spring device of claim 4 wherein the elastomeric material has a durometer in the range of about 45–85 Shore A.

6. The spring device of claim 4 wherein the durometer is of at least about 75 Shore A.

7. The spring device of claim 1 wherein the elastomeric material is a blend of natural and neoprene rubber.

8. The spring device of claim 1 wherein the first and second mounting members are partially embedded in the elastomeric material.

9. The spring device of claim 8 wherein the first mounting member is embedded by a concave wall portion extending circumferentially around the first mounting member.

10. The spring device of claim 1 wherein the larger diameter providing the parallel side wall section forms a larger section of the dome member.

11. The spring device of claim 1 connected to a rock and ride playground unit.

12. The spring device of claim 1 connected to a see-saw playground apparatus.

13. The spring device of claim 12 wherein the see-saw is constructed from a single arm member.

14. The spring device of claim 12 wherein the see-saw is constructed from two arm members which intersect each other at about ninety degrees.

15. A process for preparing an elastomeric spring for use with playground equipment comprising:

molding a substantially hollow dome member from an elastomeric material;

forming the dome member with a first diameter at one end so that the first diameter incrementally increases into a larger diameter with the larger diameter being maintained so as to provide a parallel side wall section;

placing mounting members in contact with the one end and an opposing end of the dome member; and embedding portions of said mounting members with the dome member.

16. The process of claim 15 wherein the elastomeric material is natural rubber and the mounting members are vulcanized to the dome member.

17. The process of claim 15 wherein the mounting member in contact with said first end is selected so as to have a lateral dimension no greater than about the first diameter.

* * * * *